United States Patent [19]

Poulsen

[11] Patent Number: 4,474,644

[45] Date of Patent: Oct. 2, 1984

[54] FELT CONDITIONING SYSTEM FOR PAPERMAKING MACHINES AND THE LIKE

[76] Inventor: Ole Poulsen, 185 Edward St., Fairfield, Conn. 06430

[21] Appl. No.: 544,523

[22] Filed: Oct. 24, 1983

Related U.S. Application Data

[63] Continuation of Ser. No. 494,965, May 16, 1983, abandoned, which is a continuation of Ser. No. 436,153, Oct. 22, 1982, abandoned, which is a continuation of Ser. No. 293,948, Aug. 18, 1981, abandoned, which is a continuation-in-part of Ser. No. 203,984, Nov. 4, 1980, abandoned.

[51] Int. Cl.[3] ..... B08B 5/00; D21F 7/12

[52] U.S. Cl. ..... 162/199; 15/306 A; 34/23; 34/155; 134/9; 162/252; 162/274

[58] Field of Search ..... 162/199, 252, 273, 274, 162/275, 358; 134/9; 15/306 A; 34/16, 23, 54, 111, 155

[56] References Cited

U.S. PATENT DOCUMENTS

| | | | |
|---|---|---|---|
| 959,722 | 5/1910 | Cutter | 34/111 |
| 3,347,740 | 10/1967 | Goumeniouk | 162/199 |
| 4,077,834 | 3/1978 | Stark | 162/273 X |
| 4,116,762 | 9/1978 | Gardinier | 162/199 |
| 4,270,978 | 6/1981 | Fioravanti | 162/199 |

FOREIGN PATENT DOCUMENTS

| | | | |
|---|---|---|---|
| 1810219 | 6/1969 | Fed. Rep. of Germany | 162/275 |

*Primary Examiner*—S. Leon Bashore
*Assistant Examiner*—K. M. Hastings
*Attorney, Agent, or Firm*—Patrick J. Walsh

[57] ABSTRACT

A felt conditioning system for a papermaking machine in which a stationary air supply plenum chamber is positioned on the back side, i.e., obverse of paper side, of the felt for delivering heated conditioning air to and through the felt to remove water and dirt taken up by the felt from the paper sheet.

22 Claims, 10 Drawing Figures

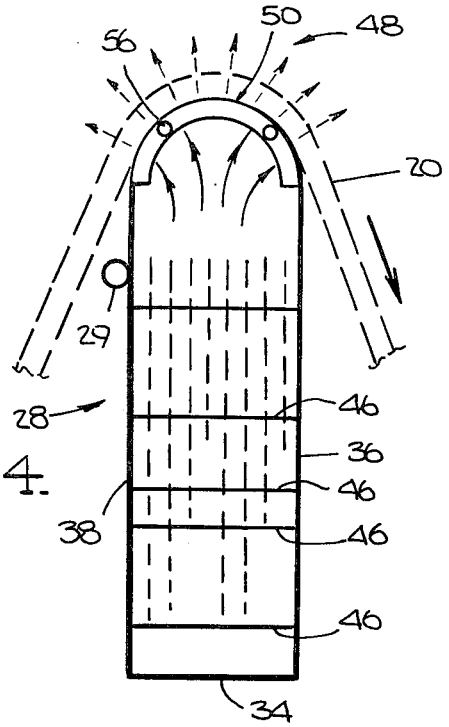
Fig. 4.
Fig. 5.
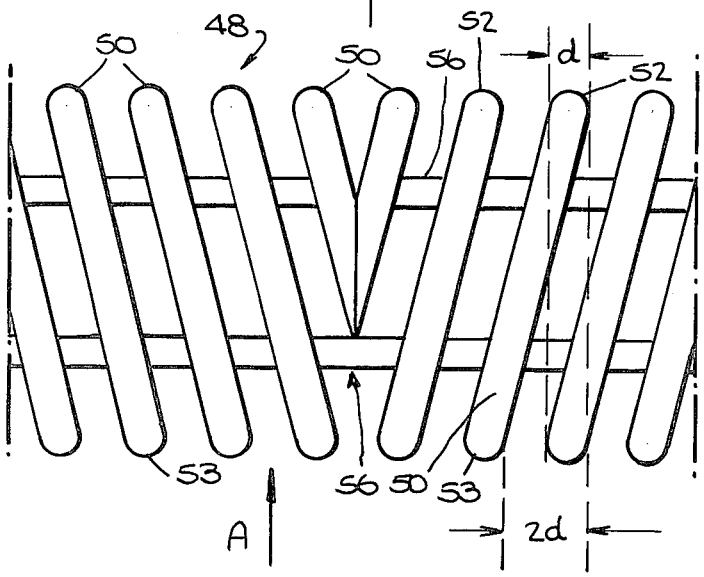

FELT CONDITIONING SYSTEM FOR PAPERMAKING MACHINES AND THE LIKE

This a continuation of application Ser. No. 494,965 filed May 16, 1983 now abandoned which is a continuation of application Ser. No. 436,153 filed Oct. 22, 1982 now abandoned, which is a continuation of application Ser. No. 293,948 filed Aug. 18, 1981 now abandoned, which is a continuation-in-part of application Ser. No. 203,984 filed Nov. 4, 1980, now abandoned.

BACKGROUND OF THE INVENTION

The present invention relates to a felt conditioning system having particular application to papermaking machinery in which travelling felts absorb water from a paper or board sheet being formed by the machine. In order to assure efficient machine operation it is necessary to dewater the felt and remove other materials picked up by the felt from the paper web such as loose fibers, clays, etc.

In the press section of a papermaking machine top and bottom endless press felts are used to remove water from a paper or board sheet being formed. For proper functioning of the endless felts it is necessary to remove all water absorbed by the felt in each revolution otherwise the felt becomes supersaturated. It is particularly important to remove absorbed water from the felt before it reaches the press nip so that the felt is properly conditioned, i.e., water has been removed to enable the felt to absorb the maximum quantity of water from the paper sheet. In conventional practice it is common to see a paper machine operating with a wet nip, i.e., a back flow of water to the incoming side of the press nip—a clear indication that the felt is supersaturated. A wet nip occurs because the felt conditioning suction boxes are not removing the quantity of water taken up by the felt for each felt cycle. A supersaturated felt travelling at 3000 fpm encounters high hydraulic forces at the press nip causing removal of fines from the paper sheet and requiring reduction in nip pressure to avoid hydraulic forces which would destroy the sheet. Of course, with reduced nip pressure less water is removed from the sheet.

Accordingly, conventional techniques for conditioning felts on operating paper machines have inherent limitations so that press felts are not properly dried.

In felt conditioning with suction boxes a saturated felt passes over a vacuum opening or slot extending across the machine beneath the felt. At machine speeds of 3000 fpm any point in the felt has a dwell time of 1.6 milliseconds over a 1-inch vacuum slot. As machine speed increases the dwell time grows shorter limiting the volume of water that can be drawn by vacuum through the slot. Moreover, removal of water from a travelling felt into a suction box requires the force of air drawn through the felt to deflect each droplet of water moving with the felt at machine speed. As machine speed increases greater air force is required to remove water from the felt. To overcome these limitations and to achieve increased water removal at greater machine speeds one may use more than one suction slot, however, the cost for this improvement is reduced felt life.

In practice, suction boxes are applied to the paper sheet side of the felt because the dirt to be removed is located toward that side of the felt. The suction boxes then wear the nap of the felt and diminish the ability of the felt to absorb water. Suction boxes are also applied to a horizontal run of the top felt after the paper side of the felt has passed over an outside roll which presses the dirt into the felt before reaching the suction box.

Another technique for felt conditioning is the honeycomb roll described in U.S. Pat. No. 4,116,762 to Gardiner. According to Gardiner the felt passes over a rotating honeycomb roll while conditioning air moves through the foraminous structure of the rotating roll and through the felt. Since the honeycomb roll rotates, the conditioning air is supplied to a stationary plenum within the roll in an axial direction from both ends of the roll. Supplying air through the roll in an axial direction is not feasible because extremely high air velocities are required in order to move the necessary volume of air through the felt for conditioning. High velocity air loses pressure as it moves through the axial supply tubes with resultant loss of air temperature and volume and diminished ability for conditioning the felt. The diameter of the honeycomb roll cannot be increased to achieve greater conditioning air volume with lower air velocities because the maximum pressure of conditioning air is inversely proportional to the radius of curvature of the felt passing over the roll at a gigven felt tension. As a result any increase in honeycomb roll diameter requires lower conditioning air pressures to avoid lifting the felt away from the honeycomb roll surface.

Felt manufacturers recommend a minimum flow of conditioning air for the honeycomb roll of 6 cubic feet per minute per square inch of felt or approximately 100 cfm per inch of felt width. For a 300-inch wide felt 30,000 cfm of conditioning air is required at velocities approaching 25,000 fpm. As the conditioning air expands through a honeycomb roll under these conditions its temperature drops to the point of freezing the water carried by the felt. In addition, water viscosity increases as temperature decreases inhibiting its removal from the felt.

A further limitation of the honeycomb roll inheres in the nature of the honeycomb roll itself. As the moving felt engages the surface of the honeycomb roll, a pocket of ambient air is trapped in the cells defined by the honeycomb structure between the felt and the pressurized plenum within the roll. Felt conditioning air in the interior plenum chamber of the honeycomb roll therefore must first compress the trapped ambient air before passing through the felt. In addition, the trapped ambient air will lower the temperature of hot conditioning air. As a result of this limitation, time is lost and the effectiveness of the conditioning air is diminished. It is not likely that these air pockets can be eliminated since the honeycomb structure requires a given depth of lattice work to achieve roll strength sufficient to support the felt under tension. In addition with the current industry trend to wider machines the honeycomb structure must have greater radial dimensions to meet strength requirements. Accordingly, the honeycomb roll is limited in utility for purposes of felt conditioning by passing pressurized air through the felt and has not been commercially used in the papermaking industry.

Another felt conditioning device is disclosed in U.S. Pat. No. 3,347,740 to Goumeniouk. This device utilizes either a rotating or a stationary tube member for supplying air under pressure to fill the voids created in a travelling felt as it expels water under the influence of centrifugal force. In order to generate sufficient centrifugal force for water removal, a very small diameter tube or roll is required. Accordingly, for reasons elaborated above, felt conditioning by use of centrifugal force and by moving air through the felt are physically incompatible techniques and cannot be used together with advantage.

SUMMARY OF THE INVENTION

The present invention is directed to a felt conditioning system in which air under pressure is delivered to a felt for removal of water and trapped substances such as paper fibers, clay, and the like accumulated in the felt in the course of removing water from a paper or board web being formed.

According to the invention a stationary air supply plenum chamber is located at the back side of the felt for delivering conditioning air to the felt. The air outlet from the chamber is fitted with a plurality of support ribs for engaging and spreading the back side of the travelling felt as conditioning air flows in a radial direction through the felt. Preferably, hot air from a convenient source such as the final dryer section of the machine is compressed and delivered to the air plenum chamber as pressurized conditioning air. The interior of the plenum is fitted with vanes for directing conditioning air radially toward the felt. In the system there is only minor loss of air temperature and there is negligible pressure differential before heated and pressurized air passes through the felt for removing water. The hot air reduces water viscosity which facilitates water removal from the felt.

In a preferred form of the invention the felt supporting ribs may be arranged in a "herringbone" pattern", i.e., at an acute angle to the machine direction in order to spread the felt as it is being conditioned. According to the invention the arcuate supporting ribs have a relatively small radius of curvature and therefore are able to take advantage of centrifugal force as an aid in water removal it being understood that centrifugal force only aids in removing saturation water from the felt thereafter being of negligible value.

As felts continue in operation, they accumulate dirt which reduces felt permeability and it is therefore necessary to reduce the volume of air delivered to the felt to avoid increasing air pressure which would lift the felt away from the supporting ribs of the air supply plenum. According to the present invention, the volume of conditioning air passing through the felt is adjusted by monitoring plenum air pressure and felt tension.

OBJECTS OF THE INVENTION

An object of the invention is to provide a felt conditioning system for a paper machine which removes the water absorbed by the felt each operating cycle so that the machine operates with a dry nip at the press rolls and with higher nip pressure.

Another object of the invention is to provide a felt conditioning system which engages the back side of the felt and does not wear the paperside nap of the felt.

Another object of the invention is to provide a felt conditioning system which effectively provides a sufficient volume of heated air for removing water and dirt from the felt.

Another object of the invention is to provide a felt conditioning system which spreads the felt in a cross machine direction to promote removal of water and dirt.

Another object of the invention is to provide means for adjusting the volumetric flow of conditioning air at constant pressure in order to maintain substantially constant felt tension.

Other and further objects of the invention will occur to one skilled in the art in practicing the invention or will be understood from the following detailed description.

DETAILED DESCRIPTION OF THE INVENTION

A preferred embodiment of the invention has been chosen for illustrating and describing its principles and is shown in the accompanying drawing in which:

FIG. 4 is a section view of the plenum taken along line 4—4 of FIG. 3.

FIG. 5 is a fragmentary top plan view of the center section of the plenum illustrating the felt support ribs.

Figure 1:
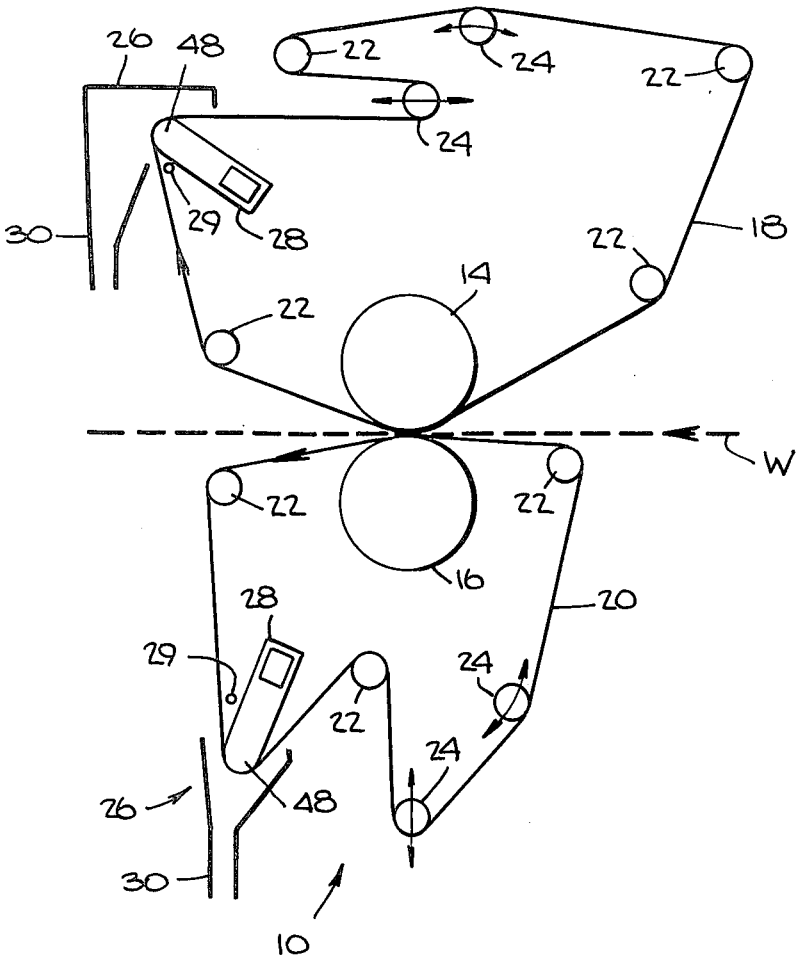
FIG. 1 is a schematic view of a press section of a papermaking machine in which the felt conditioning system of the invention is installed.

Referring now to the drawing and in particular to FIG. 1, I have illustrated the press section 10 of a papermaking machine including an unsupported board sheet web W passing through the nip of cooperating press rolls 14, 16 along with endless felts 18, 20 which remove water and a residue of fibers, clay, etc. from the board sheet. Each felt is supported over a plurality of felt rolls 22, and guiding rolls 24 and passes a felt conditioning station 26 having the felt conditioning system 28 of the present invention. A save all collection pan 30 collects and drains water and dirt removed from the felt at each felt conditioning station. It is to be understood that only one felt conditioning system is needed for each press felt. The felt conditioning stations shown in FIG. 1 are typical however they may be located at any accessible point of travel. A shower 29 for flooding the felt is located upstream of each felt conditioning station.

Figure 2:
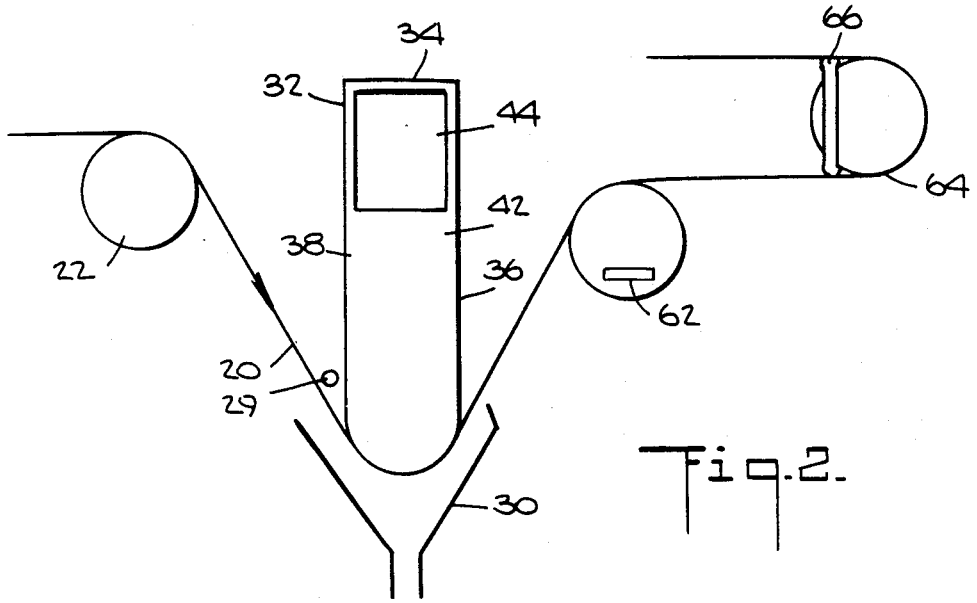
FIG. 2 is a detailed schematic view of a felt conditioning system of the invention installed in the press section of a papermaking machine.
Figure 3:
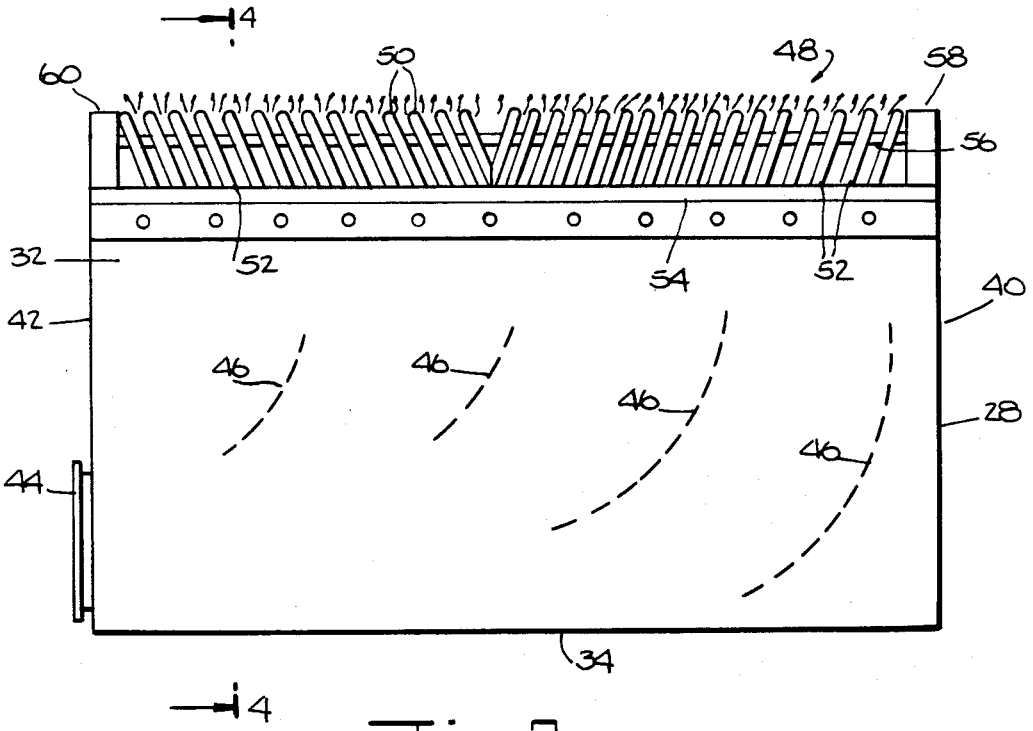
FIG. 3 is a front elevation of a felt conditioning air plenum chamber according to the invention.

Referring now to FIGS. 2 to 5 the felt conditioning system according to the invention comprises a plenum chamber 32 in the form of a box-like structure with top 34, front 36, rear 38, and end 40, 42 walls joined in any suitable air tight manner. An air supply header 44 is preferably located in one of the end walls as shown in FIGS. 2 and 3. Air directing vanes 46 are positioned within the plenum between the front 36 and rear 38 walls for the purposes of directing the conditioning air in a radial direction toward and through the felt. If desired an air supply header may be located in each end wall of the plenum chamber and in this case air directing vanes cooperate with each header to divert conditioning air radially toward the felt.

As shown in FIGS. 3–5, the felt conditioning plenum includes an open end 48 defined by a plurality of ribs 50 extending along a predetermined radius of curvature from the front wall 36 to the rear wall 38 of the plenum. The ribs are preferably fabricated of steel rods having a circular cross section to achieve minimal frictional contact with the felt and to minimize the area of felt obscured by the ribs during the felt conditioning operation. Each rib is secured at its front and rear terminal portions 52 and 53 to front and rear plenum walls. A metal shield 54 covers the front and rear terminal portions of the ribs 50 to prevent abrasion of the felt. Spaced stiffening bars 56 support and maintain desired spacing between the adjacent ribs.

In order to aid spreading of the felt during the conditioning operation, the support ribs are oriented away from the machine center line at an acute angle in the machine direction. Therefore as the felt moves over the angled support ribs in the direction indicated by the arrow in FIGS. 4 and 5, the felt spreads in the cross machine direction to open its interstices to allow more efficient water removal by the conditioning air. In order to provide uniform air flow to all sections of the felt, I prefer orienting the support ribs so that the rear terminal portion 53 of each rib is displaced in the cross machine direction from its forward terminal portion 52 a distance approximately twice its cross sectional diameter.

This preferred relationship is shown best in FIG. 5 where arrow A represents the machine direction and where the front terminal portion 52 of rib 50 is displaced two diameters *2d* in the cross machine direction from its terminal portion 53. This spacing and orientation of the ribs is essential to attaining the uniform open area of the felt in the cross machine direction.

For felt conditioning, a press felt laden with water and dirt received from the board web and from felt saturating showers is trained over the open end of the conditioning plenum. As described, the support rods being divergent in the direction of felt travel spread the felt in the cross machine direction opening its interstices to the purging action of the conditioning air. Heated air preferably taken from the final dryer section of the machine is compressed and introduced through air inlet 44 into the plenum chamber 28 thereafter passing radially through the felt for removing water and dirt as shown by arrows in FIGS. 3 and 4.

For ease of fabrication the supporting ribs forming the open end of the air plenum chamber may be formed of a stainless steel plate rolled to the desired radius of curvature with the supporting ribs formed by cutting slots in the rolled plate. The ribs formed in this manner have their lateral edges machined so that each rib has a curved surface in engagement with the travelling felt. In this form of the invention the ribs are also oriented in a divergent manner with the forward terminal portion of the rib spaced twice its effective cross sectional diameter from its rear terminal portion in the cross machine direction.

It should be pointed out that the outer edges of the plenum open end are provided with sealing strips 58, 60 which engage the lateral edges of the felt to prevent lateral escape of air from the plenum.

Figure 7:
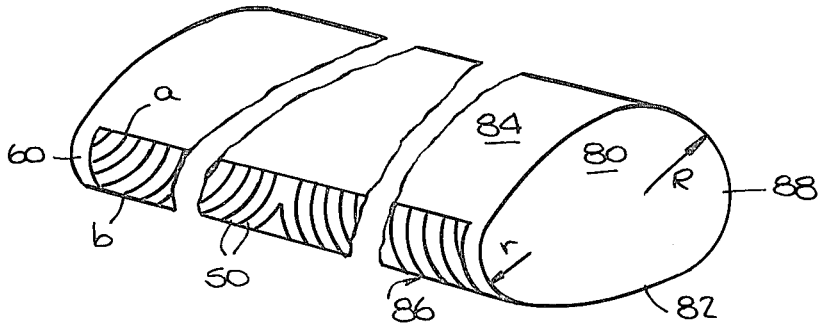
FIG. 7 is a fragmentary perspective view of a modified plenum according to the invention.
Figure 8:
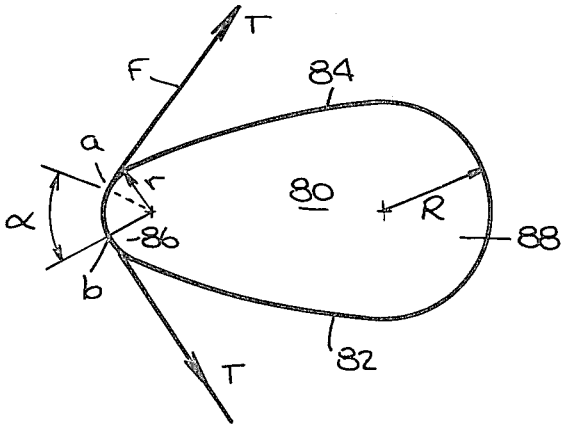
FIG. 8 is a section view of the plenum of FIG. 7.

In FIGS. 7 and 8, I illustrate a modified form of plenum chamber 80 with side walls 82, 84 having a generally egg shaped cross section characterized by an open end 86 having a small radius of curvature r and an enclosed rear section 88 having a large radius of curvature R. By this plenum chamber construction the felt F as it moves over the open end conforms to the small radius r so that, the felt tension T is kept at a minimum value for a given air pressure. Therefore, the full advantages of the invention are achieved by directing the felt over as small a radius as possible with full flow of air at a given pressure through the felt without the necessity of increasing felt tension. To provide an air seal I prefer to begin felt contact with the plenum chamber a small distance, say 2 inches, before point a and end felt contact a similar distance past point b in FIGS. 7 and 8.

In practice, an egg shaped plenum 80 may have an open end 86 defined by a small radius of curvature r of between 2 and 5 and preferably 3 to $3\frac{1}{2}$ inches with an opening of 3 to 12 and preferably 3 to $3\frac{1}{2}$ inches along the curvature $\alpha$ between points a and b. The rear section 88 of the plenum chamber has a larger radius of curvature R of between 6 and 14 inches to provide a plenum of sufficient volume to accommodate the volume of air required for purging the felt. Air flow may enter the plenum through a suitable end opening as in the embodiment of FIG. 3. The outer surfaces of side walls are curved for rigidity. The open end of the egg shaped plenum chamber is fitted with a plurality of ribs 50 in the same arrangement as FIG. 5. The plenum sidewalls 82, 84 extend the full width of the machine as with FIG. 3. With a plenum chamber in these ranges of dimensions and having an air pressure of between 3 to 10 psig, preferably 3 to 7 PSIG and a temperature between 40° and 120° F. I achieve an air flow through the felt of 7 to 25 cfm per square inch of air opening at open end of plenum chamber. This air flow range is sufficient to purge water from felts of 20 to 120 inches (water gauge) permeability. Additionally, this air flow range and felt purging is achieved regardless of machine speed, a major advantage of the present invention.

Figure 10:
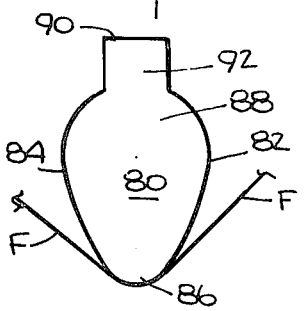
FIG. 10 is a section view taken along line 10—10 of FIG. 9.
Figure 9:
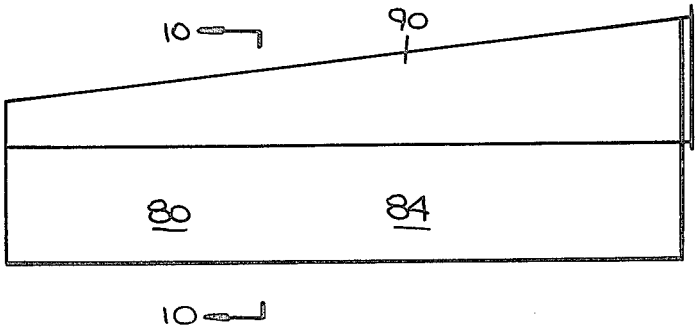
FIG. 9 is a side elevational view of a modified plenum according to the invention.

In FIGS. 9 and 10 I illustrate a further modification of the present invention comprising an egg shaped plenum 80 of FIGS. 7 and 8 with a tapered air supply duct 90 furnishing purging air through an opening 92 extending the full length of the large end of the plenum.

Figure 6:
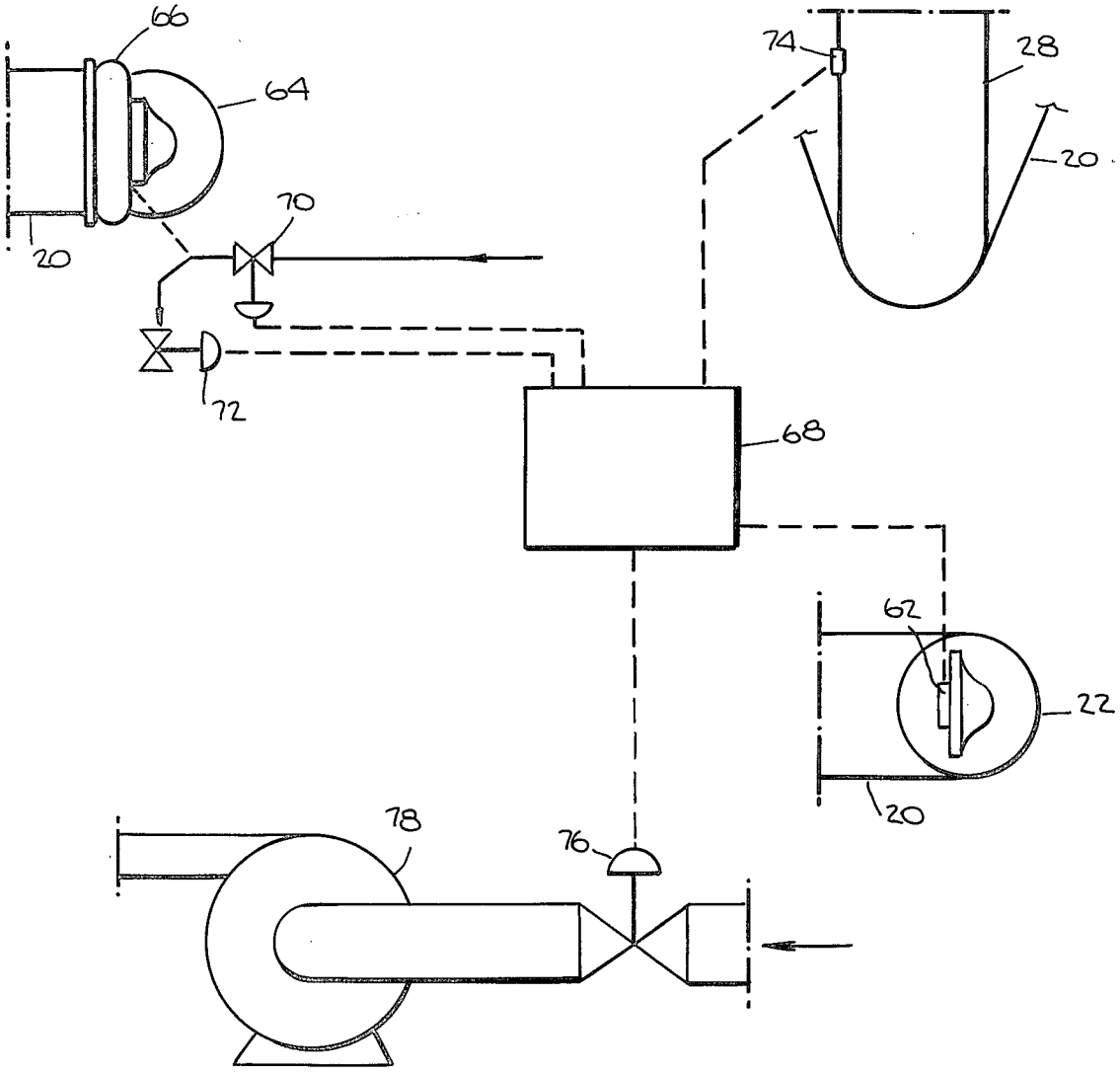
FIG. 6 is a schematic view illustrating the means for maintaining substantially constant tension in the machine felt and substantially constant air pressure in the conditioning air plenum chamber.

The maximum pressure of conditioning air is a function of felt tension and radius of curvature of the conditioning zone. With a given radius of curvature, it is necessary to maintain felt tension at a known value so that conditioning air has sufficient pressure for effective cleaning of the felt. For proper operation, the tension in the felt is greater than the product of the plenum air pressure in pounds per linear inch times the radius of curvature inches of the plenum open end. As a new felt is being used it tends to stretch or creep and it is necessary to take up the slack to maintain constant felt tension. Accordingly I provide an Emery load cell 62 (FIG. 6) or a strain gauge at a felt roll 22 journal to detect any change in felt tension. The load cell cooperates with a movable stretch roll 64 through an actuating diaphragm 66 to restore desired felt tension. As shown in FIG. 6, load cell 62 detects felt tension and signals a differential pot 68 which compares the signal to a reference value for felt tension. If the felt tension is below a desired value, the differential pot will actuate an air valve 70 admitting compressed air to the diaphragm 66 which moves slidably mounted stretch roll 64 to restore the tension of felt 20 to the desired value. A bleed valve 72 allows for reducing diaphragm pressure should it be necessary to reduce felt tension in an operating emergency.

A press felt normally accumulates embedded dirt in the course of its useful life which cannot be removed resulting in decreased permeability of the felt to condi-